United States Patent [19]

Loeffler et al.

[11] 4,167,404

[45] Sep. 11, 1979

[54] METHOD AND APPARATUS FOR COLLECTING FIBROUS MATERIAL

[75] Inventors: Romain E. Loeffler; Samuel R. Genson, both of Littleton, Colo.; Jack L. Brunk, Toledo, Ohio

[73] Assignee: Johns-Manville Corporation, Denver, Colo.

[21] Appl. No.: 921,535

[22] Filed: Jul. 3, 1978

Related U.S. Application Data

[63] Continuation of Ser. No. 780,876, Mar. 24, 1977, abandoned.

[51] Int. Cl.[2] ..... C03B 37/00

[52] U.S. Cl. ..... 65/4 R; 65/5; 65/9; 65/16; 264/121; 425/83.1

[58] Field of Search ..... 65/4 R, 9, 5, 16; 264/121; 162/292; 425/83

[56] References Cited

U.S. PATENT DOCUMENTS

| | | | |
|---|---|---|---|
| 2,450,914 | 10/1948 | Powell | 65/4 R X |
| 3,201,499 | 8/1965 | Cassé | 264/121 X |
| 3,327,503 | 6/1967 | Labino | 65/9 X |

*Primary Examiner*—Robert L. Lindsay, Jr.
*Attorney, Agent, or Firm*—Robert M. Krone; Joseph J. Kelly; William C. Anderson

[57] ABSTRACT

A method and apparatus for collecting fibrous material, particularly small diameter glass fibers, i.e. within the range of 0.05 to 2.60 microns, from a gaseous medium in an efficient, environmentally sound manner is disclosed herein. The apparatus includes a collection chamber which partially encloses a rotating drum having a perforated peripheral surface and having a fine mesh collection screen superimposed thereover. The drum is positioned in such a manner that the screen intercepts a gaseous stream of fibers, e.g. glass microfibers. A suction force established interiorly of the peripheral surface of the drum draws the gaseous stream through the collection screen in order to thereby continuously collect a layer of fibers upon a portion of the rotating screen. The layer of fibers is removed from the drum and wound on a mandrel at a point outside the collection chamber. In a preferred embodiment of the present invention the drum surface is cleaned of any residual fibers.

23 Claims, 8 Drawing Figures

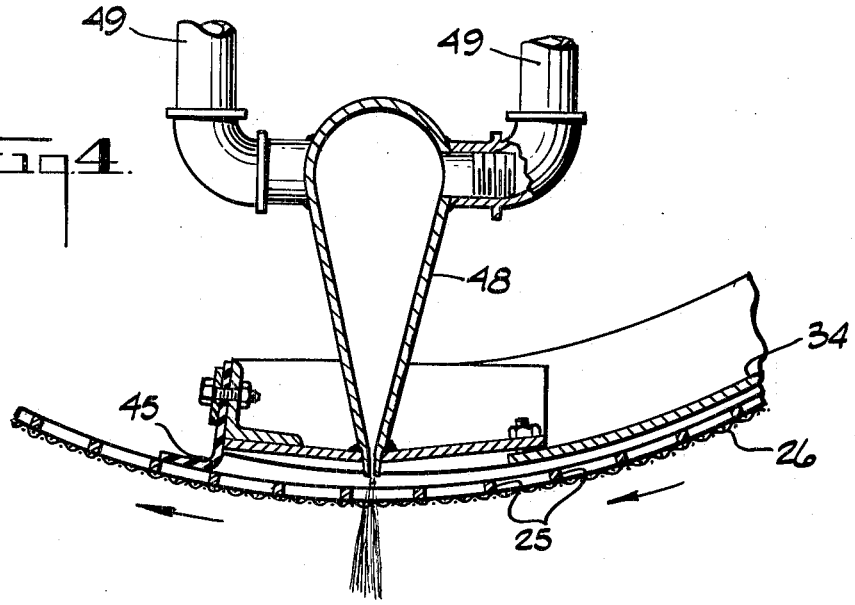
Fig. 4.
Fig. 5.
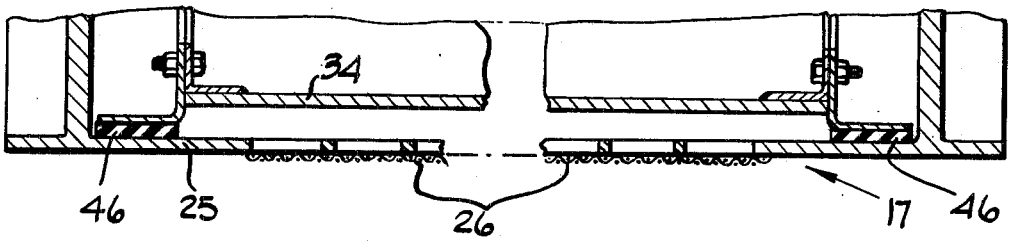
Fig. 6.
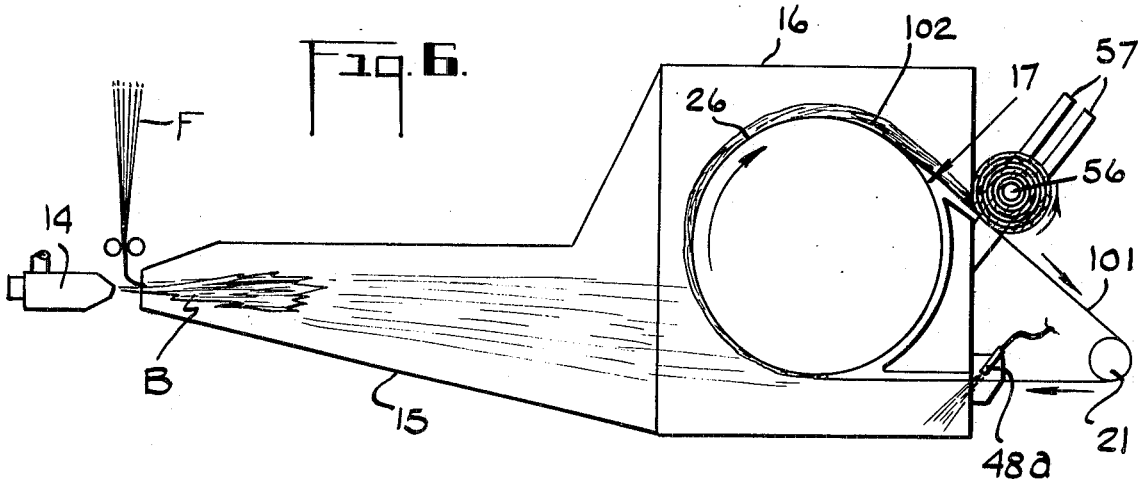

METHOD AND APPARATUS FOR COLLECTING FIBROUS MATERIAL

This is a continuation of application Ser. No. 780,876, filed Mar. 24, 1977 now abandoned.

BACKGROUND OF THE INVENTION

1. Field of the Invention

The present invention relates to a fiber collection system. More particularly, the present invention relates to a method and apparatus for collecting fibrous material, e.g. glass microfibers.

2. Description of the Prior Art

One conventional method of forming glass fibers utilizes hot, high velocity gaseous blasts to attenuate the fibers during formation. The gaseous blasts with entrained fibers and a large volume of inspirated process air are contained and conducted by a forming tube and discharged into a collection chamber and onto a moving perforated collection surface upon which the fibers are collected. A sucton means draws spent gas and air through the collection surface.

Emission control problems arise with such a known method, particularly with the production of small diameter or microfibers (e.g. 0.05–2.60 micron diameter fibers and typically 0.1 to 0.7 micron diameter fibers) due to the difficulty of efficiently handling a large volume of moving gases. Furthermore, the gas entrained fibers tend to escape into the ambient surroundings, especially in the regions adjacent the moving collection surface and the collection chamber. The collection surface often becomes clogged with fibers which causes fibers to be blown around the production area since a fiber clogged collection surface prevents efficient exhausting of the gases. This clogging problem necessitates replacing the collection surface, e.g. screen material, frequently. This substantially diminishes the efficiency of the system due to interrupted production and excessive down-time. In addition, it is often necessary to install expensive emission control systems to avoid discharging fibers into the atmosphere.

BRIEF DESCRIPTION OF THE INVENTION

In view of the foregoing it is an object of the present invention to provide an apparatus for the efficient and effective collection of fibers, particularly microfibers.

Another object of the invention is to provide a microfiber collection apparatus which minimizes emission of fibers to the environment thereby reducing the need for supplemental emission control systems.

A further object of the present invention is to provide an efficient method of collecting fibers.

Another object of the invention is to eliminate or substantially reduce the need to preheat process air.

Accordingly, the present invention provides a method and apparatus for collecting fibrous material which includes a collection chamber and a rotating fluid pervious collection drum preferably having a fine mesh screen positioned around its peripheral surface. The collection drum is rotated along a path, a major portion, i.e. at least half, of which is within the collection chamber, and a minor portion of which is located outside the collection chamber. Fibrous material is drawn onto the peripheral surface of the collection drum moving along the portion of the path within the collection chamber. The portion of the path outside the collection chamber is sealed from the interior of the collection chamber.

The collected fibrous material is removed from the path while the collection drum moves through the portion of the path outside the collection chamber.

BRIEF DESCRIPTION OF THE DRAWINGS

FIG. 4 is an enlarged, fragmentary sectional view of an air knife;

FIG. 5 is a sectional view of a baffle plate and the collection drum taken along line 5—5 of FIG. 3 with their associated seals;

FIG. 6 is a schematic view and side elevation illustrating a modification of the present invention;

DETAILED DESCRIPTION OF THE INVENTION

Figure 1:
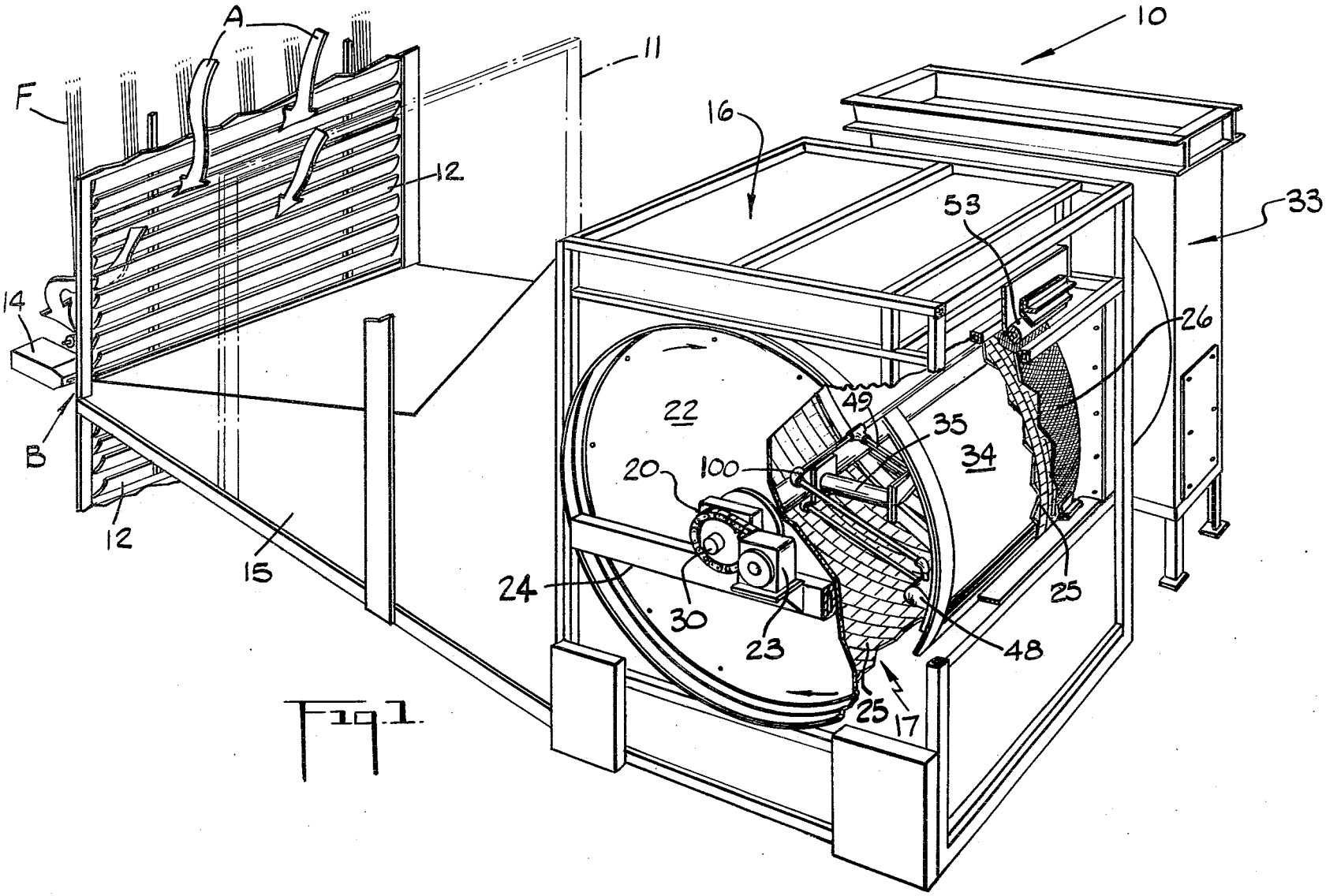
FIG. 1 is a perspective view of a collection chamber of an apparatus for the formation and collection of fibers according to the present invention partially cut away to illustrate the interior and detail of a collection drum.

Referring to FIG. 1, in a collection apparatus 10, filaments of glass F are continuously advanced transversely into hot, high velocity gaseous blasts B produced by a plurality of burners 14. The burners 14 are preferably arranged so as to discharge substantially horizontal blasts. The gaseous blasts B attenuate the filaments F into fine staple fibers. The gaseous blasts, the fibers entrained therein and inspirated process air, generally indicated by arrows A, are contained and directed via a forming tube 15 and are discharged into a collection chamber 16 including a rotatable collection drum 17.

The inspirated air is preferably drawn in along the path indicated by the arrows A in FIG. 1 through a set of louvers 12 which can be adjusted so as to control the amount of air inspirated into the forming tube 15. A wall 11 helps contain and channel the process air through the louvers 12 where the air is then inspirated into the forming tube. With such a system, process air need not be drawn from the area behind the burners 14 where operators monitoring the process are typically located. Consequently, any air drawn through the area behind the burners needs to be heated so as to maintain comfortable working conditions for the operators. Thus, with the louvers of the present invention whereby air is inspirated into the forming tube 15 along the path indicated by the arrows A, there is no need to heat the process air.

Figure 3:
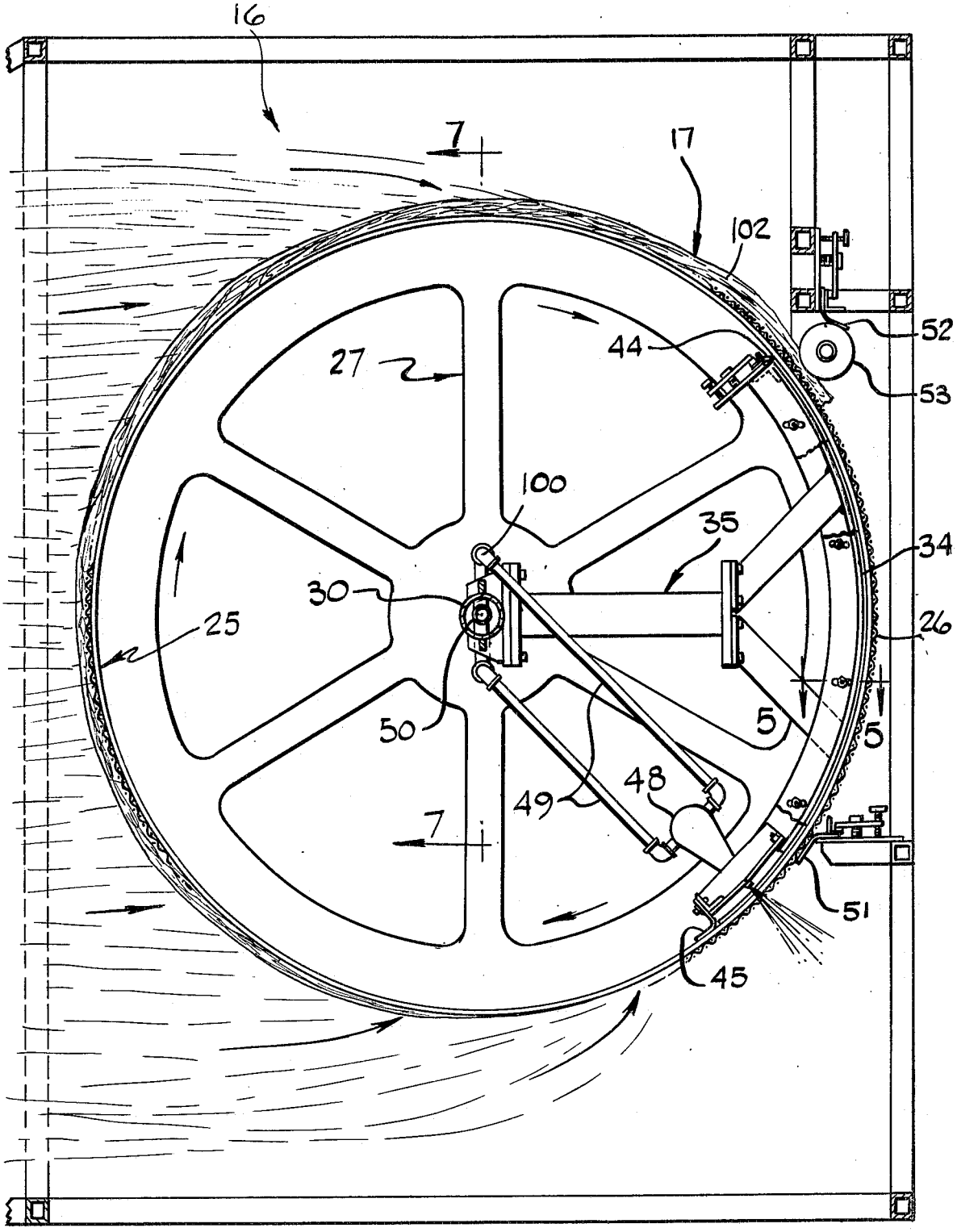
FIG. 3 is an end view of the drum and associated equipment taken from the same position as FIG. 2 but with the chamber wall and drum end removed.

The collection drum 17 is adapted to be rotated in the direction indicated by the arrows in FIGS. 1 and 3 and may be driven by any suitable means. The collection drum 17 has a peripheral collection surface 25 which rotates along a path, a major portion of which path is within the collection chamber 16 and a minor portion of which is outside the collection chamber 16.

In the embodiment illustrated in FIG. 1, the forming tube 15 is comprised of one section having a relatively small cross-section at the end adjacent the burners 14. The cross-section of the end of the forming tube 15 adjacent the collection chamber 16 is comparatively large and results in the discharge of the fibers over a substantial portion of the collection surface within the collection chamber 16.

Figure 8:
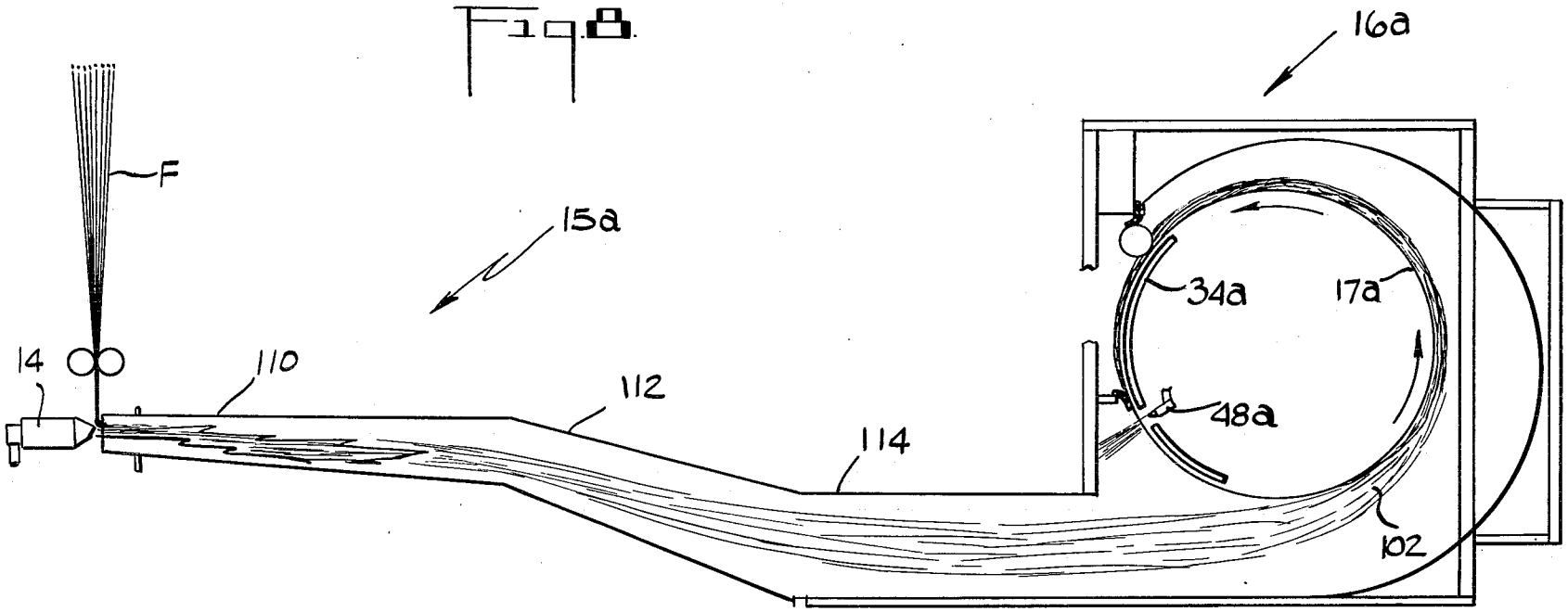
FIG. 8 is a schematic view and side elevation illustrating a modification of the present invention.

Other configurations for the forming tube 15 would be suitable for use with the collection apparatus 10 of the present invention. For example as shown in FIG. 8, a forming tube 15*a* can have multiple sections. In such a modification, a first section 110, positioned adjacent the burners 14, is arranged substantially horizontally. This first section may be constructed of any suitable refractory material, e.g. panels of asbestos fibers and diatomaceous silica marketed under the registered Trademark MARINITE by Johns-Manville Corporation. A refractory material is necessary since the temperature at the burners 14 is approximately 3000° F.

A second section, or mid-section 112 of the forming tube 15*a* is positioned intermediate the first section 110 and a third section 114. The mid-section 112 of the forming tube 15*a* is constructed of any suitable material, e.g. stainless steel and is oriented in such a manner that the end of the mid-section attached to the third section 114 is substantially lower than the end of the mid-section attached to the first section. In this modification of the present invention, such an orientation serves to lower the fiber path in such a manner that the fibers enter a collection chamber 16*a* at a point beneath collection drum 17*a*. Any other suitable method of achieving this end, that is entry of the fibers from a point beneath the collection drum, would also be suitable. For example, the collection drum 17*a* can be positioned relatively higher than the burners 14 and the forming tube 15*a* could then be oriented in a substantially horizontal position.

The end of the mid-section 112 attached to the third section 114 typically has a greater cross-sectional area than the end of the mid-section attached to the first section 110. The increased cross-sectional area of the downstream end of the mid-section serves to slow down the velocity of the gaseous stream and entrained fibers.

The third section 114 of the forming tube 15*a* is attached at one end to the mid-section and its other end is open to the collection chamber 16*a*. The third section is of substantially constant cross-section and, like the mid-section, can be constructed of stainless steel. The third section 114 is oriented in a substantially horizontal position and opens into the collection chamber 16*a* at a point beneath the collection drum thereby preventing direct impingement of the fibers onto the collection screen of the collection drum. This minimizes fiber penetration into and through the collection screen mesh, thereby minimizing emission problems and clogging of the collection screen surface.

Other orientations of the forming tube in this embodiment are suitable, e.g. the forming tube 15*a* can open into the collection chamber at a point above the collection drum or the forming tube can also be oriented to open in such a manner that the axis of the forming tube, that is the major directional line of travel for the fibers, is at some angle other than perpendicular to the rotational axis of the collection drum. With such systems, although the suction force still draws the fibers onto the collection screen, the fibers are not directly impelled onto the collection screen by the force of the gaseous blasts B and the inspirated process air.

Figure 7:
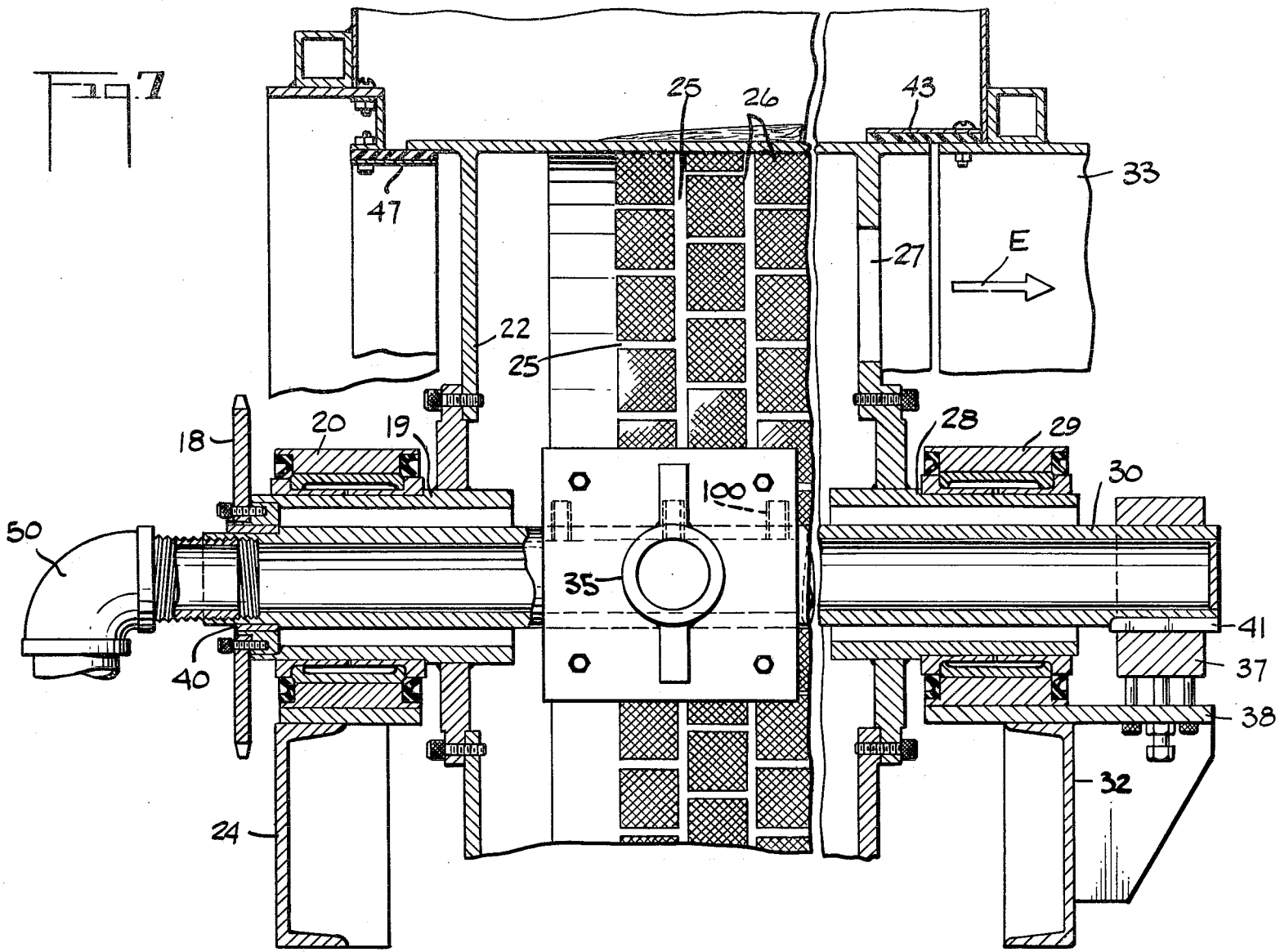
FIG. 7 is a fragmentary sectional view taken along line 7—7 of FIG. 3.

In the illustrated embodiment (see FIGS. 2 and 7), a sprocket 18 is connected by a tubular stub shaft 19 (FIG. 7) to a rotatable end plate 22, and is chain driven by an electric motor 23 or other suitable source of power. The tubular stub shaft 19 is supported for rotation by bearings housed in a journal box 20. The journal box 20 and the electric motor 23 are supported by a beam 24 which is attached to a suitable framing structure 11. The end of the drum opposite the drive end, that is, the end adjacent an exhaust duct 33 (FIG. 1) is similarly supported; i.e. a spider 27 (FIG. 3) is supported by a tubular stub shaft 28 which rotates in a journal box 29 (FIG. 7). The journal box 29 is mounted on a beam 32, also supported by the framing structure 11.

The peripheral surface 25, of the collection drum 17 is made of a perforated metal sheet. Hot rolled steel 5/16 inch thick and having 2 1/16 inch square holes punched on 2⅜ inch centers in staggered rows, is suitable. Other types of perforated metal can be used for the collection drum surface, e.g. round holes, oblong holes, etc. or flattened expanded sheet metal. A fine mesh collection screen 26, e.g. a stainless-steel wire cloth is attached to the peripheral surface 25. The collection screen 26 can be attached to the periphery of the collection drum 17 with a high temperature epoxy adhesive and joined to itself at its overlapping edges by epoxy and silver solder. Other suitable means of attaching the screen to the collection drum surface can be used, e.g. "snap-in" sections which decrease replacement time. The size of the screen mesh is dependent on the size of the fibers to be collected. Finer mesh size is utilized for small diameter fibers and larger screen is used for coarser fiber collection. A 32 mesh screen (0.0238 inch wide openings) has been found to be quite suitable for the collection of microfibers.

Finer mesh screens, e.g. 46 mesh (with 0.0172 inch wide openings) allow lower fiber emission rates into the exhaust but tend to have a shorter operating life. Such shorter operating life is due to the smaller diameter wire in such finer mesh screens which wears through more rapidly than the wire in coarser screens and which tends to flex more in place causing the wire to break more rapidly.

The finer mesh screen operating life problem can be satisfactorily handled by improved fastening methods for attaching the screen to the collection drum. For example, multiple discrete snap-in segments can be used which have less of a flex tendency than a continuous sheet of screen and are easier to replace when the screen does wear.

For a given rate of the production, the collection drum is rotated faster for the collection of fine diameter fibers than for the collection of coarse fibers since finer fibers tend to block the screen holes more rapidly.

In an actual working embodiment of the present invention, the speed of the rotation of the collection drum is set so as to maintain a collection screen loading of 2.63 grams of fibers per square foot. However, slower rotational speeds can be used, e.g. 3.31 gms/sq. ft. loading, but slower rotational speed results in a high pressure drop across the fibers and collection screen which forces the fibers into and through the interstices of the screen resulting in fiber emission through the exhaust duct 33.

The spiders 27 at the end of the drum 17 adjacent the exhaust duct 33 provide openings so that the interior of the collection drum 17 communicates (as indicated by arrow E in FIG. 7) via the exhaust duct 33 with a suitable large-capacity exhaust or suction blower (not shown). The exhaust duct 33 may also be equipped with conventional dampers to control the amount of air drawn through the collection drum.

As shown in FIG. 3, an approximately 80° segment of the peripheral wall of the collection drum 17 is separated from the suction effect of the exhaust blower by an arcuate baffle plate 34. This section of the collection drum 17 is exposed to the atmosphere on the outside of the collection chamber 16. The baffle plate 34 is positioned on the interior wall of the peripheral surface 25 by a support member 35 (FIGS. 1 and 3) which in turn is secured to a stationary tubular shaft 30. As shown in FIG. 7, the tubular shaft 30 is mounted in a block 37 which is fastened to a base plate 38 mounted on the beam 32. A key 41 locks the tubular shaft 30 against rotation. The tubular shaft 30 extends axially through the interior of the collection drum 17 and is supported at the drive end of the collection drum 17 by bearings 40 located at the hub of the tubular stub shaft 19 on which the sprocket 18 rotates relative to the stationary shaft 30. The baffle plate 34 is sealed against the interior surface of the collection drum 17 along its upper and lower edges by longitudinally extending flexible seals 44 and 45 (FIG. 3), and, as shown in FIG. 5, along its side edges by seals 46.

The flexible seals 44 and 45 and the two seals 46 are held in position in a sealing relationship by metal angles which press the seals against the peripheral surface 25 of the collection drum. The seals 44, 45 and 46 are preferably made of a polytetrafluoroethylene impregnated asbestos fabric, e.g. ASBESTAN material produced by Johns-Manville Corporation which is a Teflon (trademark of E. I. du Pont de Nemours Co.) impregnated asbestos fabric.

As shown in FIG. 7, two additional seals 43 and 47 are provided and are preferably comprised of a polytetrafluoroethylene impregnated fabric such as ASBESTAN fabric. The seal 47 is disposed between the end plate 22 of the collection drum 17 and the collection chamber 16. The seal 47 is positioned in such a manner that air adjacent the exterior of the collection chamber is not inspirated into the collection chamber. The seal 43 is positioned between the collection chamber 16 and the exhaust duct 33. The seal 43 prevents fibrous material from bypassing the collection screen and entering directly into the exhaust duct 33.

A baffle plate 34*a* (FIG. 8) is similarly sealed as the baffle plate 34 and serves a similar function, i.e. it inhibits the suction force within the collection drum 17*a* from acting on that portion of the path of the collection drum outside the collection chamber 16*a*.

Figure 2:
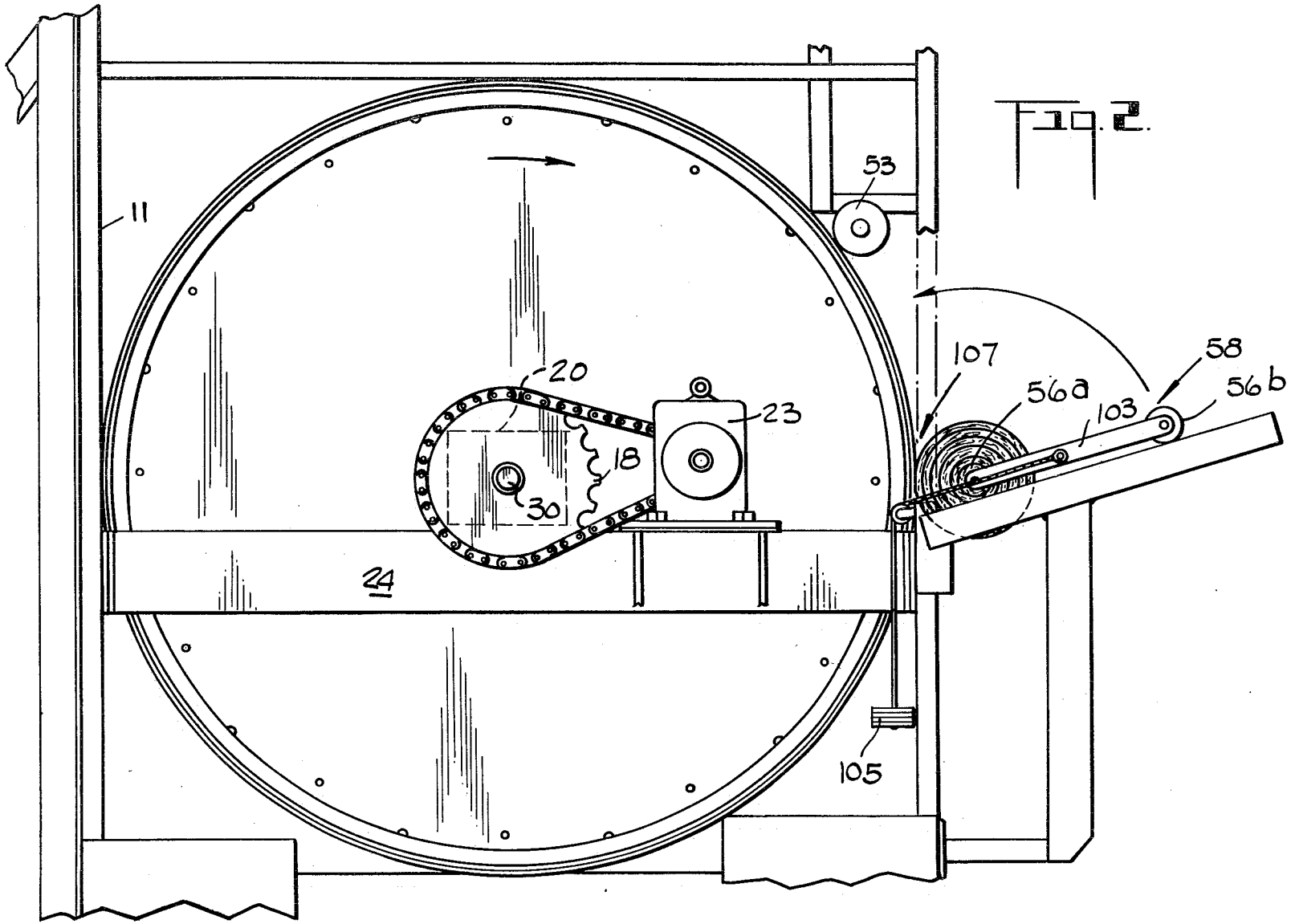
FIG. 2 is an end view of the collection drum shown as FIG. 1 with associated equipment.

As shown in FIGS. 1, 2 and 3, an air knife 48 is attached along the longitudinal lower edge of the baffle plate 34 and includes longitudinally extending fluid nozzles positioned to clean residual fibers from the collection screen 26 and the peripheral surface 25 of the collection drum 17 after the fibers have been removed from the collection screen at a point of the path outside the collection chamber 16. Due to the longitudinally extending seal 45, the air knife 48 operates without influence from the low pressure zone within the collection drum. Compressed air or other fluid under low pressure and high volume (e.g. approximately 5.5 psi and 635 cfm) is fed to the air knife 48 from a source 50 external of the apparatus framing structure 11 and via a plurality of pipes 49, which are connected through the center of the stationary shaft 30 at nipples 100.

In operation, the gaseous blasts B, the inspirated air drawn along the path indicated by the arrows A, and the entrained fibers are discharged into the collection chamber 16 via the forming tube 15. A major portion, e.g. approximately 280° of the screen-covered collection drum surface, serves as a wall within the collection chamber and thereby intercepts the fibers. As shown in FIG. 3, a longitudinally extending outer seal 51 and a longitudinally extending upper outer seal 52 which cooperates with an idler roll 53 also help confine the gaseous stream of fibers within the collection chamber. The idler roll 53 serves as a moving seal that is adjustable to varying collection thicknesses while still maintaining an effective seal between the atmosphere and the collection chamber 16.

The suction established within the drum interior by the exhaust blower through the exhaust duct 33, continously draws spent gases and process air through the screen-covered collection drum surface. The fibers entrained in the gaseous blasts are collected on the collection screen 26 and are held on the screen by suction force until the collection drum rotates to a point beyond the idler roll 53 i.e. to a point along the path which is outside the collection chamber 16. The baffle plate 34, appropriately sealed as described above, confines the suction effect to the major portion of the screen, e.g. the 280° portion, that is moving within the collection chamber at any given moment. The baffled portion of the drum, e.g. the approximately 80° which is exposed to the atmosphere, is utilized for removing the collected fibers from the path.

In the embodiment of the present invention illustrated in FIG. 8 the baffle plate 34*a* is attached to an air knife 48*a* in a similar manner as that discussed above with regard to baffle plate 34 and the air knife 48. The air knife 48*a* cleans any residual fibers from the collection drum 17*a* and its collection screen after collected fibers 102 are removed from the path at a point outside the collection chamber 16*a*.

In another embodiment of the invention, fibers are collected by a conveyor belt 101 as shown in FIG. 6. In this embodiment, the collection screen 26 lies against the peripheral surface 25 of the collection drum while it is within the collection chamber 16, preferably, for example approximately 250° of the circumference of the collection drum 17. The conveyor belt 101 is mounted on a roller 21 and travels from a position adjacent the collection drum to a material take-off position outside the collection chamber 16. As FIG. 6 further illustrates, an air knife 48*b*, which is similar in construction to the air knife 48, discharges a high volume fluid jet through the collection screen 26 and conveyor belt 101 thereby cleaning residual fibers from the collection screen and conveyor belt and into the collection chamber 16.

The collected fibers can be taken off the collection screen in several ways. FIG. 6 illustrates one method wherein a lightweight gathering mandrel 56, controlled by appropriate guides 57, is laid against a layer of collected fibers 102 and an initial wrap is manually performed so as to form a first layer around the mandrel. Thereafter the gathering mandrel 56 is frictionally rotated and wind-up of the collected fibers 102 continues until a predetermined roll size is achieved. The mandrel is then replaced by an empty one. The wrapped material can then be stripped from the completed mandrel and packaged for shipment.

The gathering mandrel is preferably changed frequently, e.g. approximately every 10 minutes for an operation producing 60 pounds of fiber per hour. This produces a package of approximately 10 pounds when collecting 0.5–0.7 micron diameter fiber. Since the collection screen 26 gradually retains more fibers as the mandrel package is building, the amount of air passing through the screen is reduced which thereby reduces the static pressure within the forming tube. A small mandrel, e.g. an empty gathering mandrel, removes the fibers from the collection screen more efficiently which thereby presents more open area for air passage thus increasing the forming static pressure and reducing the temperature in the exhaust gas since more air can be inspirated into the forming tube.

A second method of winding the collected fibers 102 utilizes a multi-position turret which is adapted to receive three rotatable gathering mandrels aligned such that the rotational axis of each mandrel is parallel to the rotational axis of the collection drum. After one of the gathering mandrels is fully wrapped, the turret is rotated to bring an empty gathering mandrel into position against the collection screen for winding the collected fibers 102.

A third method of winding the collected fibers is illustrated in FIG. 2 and involves a "flip-flop" arrangement 58. First and second mandrels **56*a* and 56*b* are rotably mounted on either end of a bar 103 having a counterweight 105 acting on its center. The first mandrel 56*a* begins winding the collected fibers 102. Upon reaching a predetermined package size and weight on the first mandrel 56*a*, the second mandrel 56*b* is swung over to a point on the collection drum surface between the idler roll 53 and the wind-up position, indicated at reference numeral 107. The first mandrel 56*a* is then pulled outwardly away from the collection screen 26 and the second mandrel 56*b* drops into the proper wind-up position at 107. The second mandrel 56*b* is pre-wetted which causes the collected fibers 102 to gegin winding around the second mandrel 56*b*. During the winding opertion on the second mandrel, the fibers can be stripped from the first mandrel 56*a* so that upon completion of the wrapping process on the second mandrel 56*b***, the process can be repeated.

Other methods of collecting the fibers from the screen can be utilized. For example the fibers can be vacuumed from the screen rather than frictionally winding them onto a rotating mandrel. In an embodiment wherein the collection apparatus utilizes 30,000 cubic feet of air per minute, fibers can be vacuumed off the collection screen and recollected with a vacuum force of approximately 600–700 cfm. In another method the collection screen can be supplied with a pervious paper or felt upon which the fibers can be collected. The collected fibers and the felt or paper can then be removed together by, for example, one of the winding operations discussed above.

Any fibers that may remain upon the screen after such removal are cleaned by a high volume fluid jet e.g. by the air knife 48, **48*a* or 48*b*. Clogging of the collection screen 26 with residual fibers is thereby prevented, and since the air knife is positioned so as to discharge the fibers into the collection chamber 16**, the screen is not only efficiently cleaned but atmospheric emissions of fibers is also mimimized.

Furthermore, since the fibers are discharged into the collection chamber 16 they can be recollected on the collection drum. This minimizes operator exposure to the fibers and also eliminates scrap from the process which results in more efficient and economical collection system than that of the prior art.

It is apparent that, within the scope of the invention, modifications and different arrangements may be made other than herein disclosed, and the present disclosure is illustrative merely, the invention comprehending all variations thereof.

What is claimed is:

1. Apparatus for producing and collecting fibrous material comprising:

(a) a collection chamber;

(b) means for producing a stream of fibrous material and directing said stream to said collection chamber;

(c) a collection drum having a fluid pervious peripheral surface, said collection drum being rotatable so that said peripheral surface moves in a path, at least half of said path being located within said collection chamber and a portion of said path being located outside said collection chamber;

(d) means for rotating said collection drum so that said peripheral surface moves in said path;

(e) means for drawing fibrous material onto said peripheral surface of said collection drum moving along said path within said collection chamber;

(f) means for sealing said portion of said path outside of said collection chamber from said at least half of said path within said collection chamber; and (g) means for removing said fibrous material from said collection drum while moving said peripheral surface through said portion of said path outside said collection chamber.

2. An apparatus according to claim 1 further comprising means for cleaning said peripheral surface of said collection drum after said fibrous material has been removed, said cleaning means including means located interiorly of said peripheral surface opposite said collection chamber, for discharging a fluid stream outwardly through said peripheral surface and into said collection chamber, for returning any residual fibers to said collection chamber.

3. An apparatus according to claim 2 wherein said movable collection drum has a fine mesh collection screen covering at least a portion of said peripheral surface and means for establishing a suction force interiorly of said drum so that fibrous material is collected on said collection screen while within said collection chamber.

4. An apparatus according to claim 3 wherein approximately 280° of the circumference of said collection drum is within said collection chamber.

5. An apparatus according to claim 4 wherein said collection screen is adjacent the peripheral surface of the drum throughout the entire circumference thereof.

6. An apparatus according to claim 3 wherein said collection screen lies adjacent the peripheral surface of said collection drum within the collection chamber and diverges from said peripheral surface of said collection drum to a position outside said collection chamber.

7. An apparatus according to claim 3 wherein said fine mesh screen has square openings, the width each being within the range of about 0.0172–0.0238 inch.

8. An apparatus according to claim 3 wherein said means for sealing includes a baffle plate flexibly sealed with sealing means to the interior surface of that portion of said collection drum moving along said portion of said path outside said collection chamber, a sealing means located between the peripheral surface of said collection drum adjacent an open exhaust end of said collection drum which is connected with an exhaust duct so as to prevent said fibrous material from bypassing said collection screen and a sealing means located between the peripheral surface of said collection drum adjacent the drum end opposite said open exhaust end and a support frame such that air outside said collection chamber is not inspirated into said collection chamber.

9. An apparatus according to claim 8 wherein said sealing means includes seals comprising polytetrafluoroethylene coated asbestos cloth.

10. An apparatus according to claim 8 wherein said means for sealing further includes an idler roll positioned adjacent said collection screen at a point outside said collection chamber which serves as a moving seal that is adjustable to varying collection thicknesses.

11. An apparatus according to claim 3 wherein said means for cleaning comprises a fluid knife which includes a fluid nozzle having at least one discharge port extending parallel to the rotational axis of said collection drum and being located interiorly of said peripheral surface of said collection drum in order to direct a fluid stream outwardly through said peripheral surface for returning any residual fibers to said collection chamber.

12. An apparatus according to claim 8 wherein said means for cleaning comprises a fluid knife which includes a fluid nozzle having at least one discharge port extending parallel to the rotational axis of said collection drum and being located interiorly of said peripheral surface of said collection drum in order to direct a fluid stream outwardly through said peripheral surface for returning any residual fibers to said collection chamber.

13. An apparatus according to claim 12 wherein said fluid knife is an air knife and said fibers are micro fibers having diameters within the range 0.05–2.60 microns.

14. An apparatus according to claim 1 wherein said removal means comprises at least one mandrel rotatably mounted and adapted to be positioned adjacent the collection drum at a point outside said collection chamber whereby friction at the interface between said peripheral surface of said collection drum and said mandrel causes said collected fibrous material to be wound upon said mandrel.

15. Apparatus according to claim 12 wherein said removal means comprises at least one mandrel rotatably mounted and adapted to be positioned adjacent the collection screen outside said collection chamber whereby friction at the interface between said collection screen and said mandrel causes said collected fibrous material to be wound upon said mandrel.

16. An apparatus according to claim 12 including a shaft which extends axially through said collection drum for supporting said baffle plate and which also serves as supply means for said fluid knife.

17. An apparatus according to claim 1 further including louvers which direct process air into the collection chamber.

18. An apparatus according to claim 12 further comprising a forming tube for directing fibrous material to said collection chamber said forming tube being oriented so as to open into said collection chamber in such a manner that the axis of the forming tube does not intersect said collection screen.

19. An apparatus according to claim 3 further comprising a forming tube for directing fibrous material into said collection chamber said forming tube being oriented so as to open into said collection chamber in such a manner that the axis of the forming tube at its opening is not perpendicular to the rotational axis of said collection drum.

20. A method of producing and collecting fibrous material within a collection chamber including the steps of:

(a) producing and directing a stream of fibrous material towards a collection chamber;

(b) rotating a collection drum to move a fluid pervious peripheral surface thereof along a path, at least half of said path being located within said collection chamber and a portion of said path being located outside said collection chamber;

(c) drawing fibrous material onto said peripheral surface as it moves in said path within the collection chamber;

(d) sealing said portion of said peripheral surface moving in said portion of said path outside the collection chamber from said at least half of said path within said collection chamber; and (e) removing said fibrous material from said path while said peripheral surface moves through said portion of said path outside said collection chamber.

21. A method according to claim 20 further including the step of cleaning residual fibers remaining on said peripheral surface of said collection drum after removal of the collected fibers outside said collection chamber, said cleaning step including forcing a high volume low pressure fluid through said peripheral surface of said collection drum and into said collection chamber.

22. A method according to claim 21 further including covering at least a portion of the peripheral surface of said rotating collection drum with a fine mesh screen and establishing a suction force interiorly of said collection drum so that said portion of said collection drum and said collection screen within said collection chamber collect said fibrous material.

23. A method according to claim 22 wherein said sealing step includes flexibly sealing the interior surface of said portion of the collection drum moving along said portion of said path outside said collection chamber and sealing said peripheral surface of said collection drum from areas outside said collection chamber.

* * * * *